United States Patent [19]

Gaddis

[11] Patent Number: 4,782,628

[45] Date of Patent: Nov. 8, 1988

[54] GATE OPENING APPARATUS

[76] Inventor: John J. Gaddis, Rte. 1, Box 422, Edwards, Miss. 39066

[21] Appl. No.: 8,469

[22] Filed: Jan. 29, 1987

[51] Int. Cl.[4] ..... E05F 15/10

[52] U.S. Cl. ..... 49/340; 49/344; 49/356

[58] Field of Search ..... 49/340, 341, 343, 344, 49/345, 339, 356

[56] References Cited

U.S. PATENT DOCUMENTS

| | | | |
|---|---|---|---|
| 425,962 | 4/1890 | Stockton . | |
| 2,371,336 | 3/1945 | Levan | 49/340 |
| 2,540,538 | 2/1951 | Matchett | 49/340 |
| 2,911,211 | 11/1959 | Umbricht | 49/340 |
| 3,500,585 | 3/1970 | Vollmar . | |
| 4,403,449 | 9/1983 | Richmond . | |
| 4,416,085 | 11/1983 | Lybecker et al. . | |
| 4,638,597 | 1/1987 | Lybecker | 49/345 |

*Primary Examiner*—Kenneth J. Dorner
*Assistant Examiner*—Gerald A. Anderson
*Attorney, Agent, or Firm*—Anthony A. O'Brien

[57] ABSTRACT

A housing and telescoping arm are supported by a shaft pivot pivotally mounted in the ground. The telescoping arm includes a rotating rod actuator journalled for rotation in a bearing mounted atop the shaft. The rod includes a threaded portion extending longitudinally from the shaft to the gate. A traveling tubular member is mounted concentrically with the rod and includes a block having a threaded bore for receiving the threads of the rod. The arm is connected to the gate through a pinned connection between one end of the traveling member and a lower rail of the gate. Relative rotation between the rod an the traveling member is prevented by the pinned connection. As a result, the traveling member extends outwardly and retracts inwardly in response to the counter-clockwise and clockwise rotation respectively of the rod. A motor and transmission for driving the rod in rotation are mounted in the housing along with a motor control circuit. The motor control circuit receives a start switch signal and shuts the motor off after the gate has swung to either the open or closed positions by receiving a stop signal from a limit switch. The direction of the motor is reversed each time a signal is received from a limit switch so that the gate is alternately opened and closed by the apparatus. The apparatus can be used in areas not supplied with commercial power, since it is battery powered. A solar cell panel recharges the battery so that a completely self-sufficient operation is provided.

4 Claims, 3 Drawing Sheets

GATE OPENING APPARATUS

BACKGROUND OF THE INVENTION

1. Field of the Invention

The invention relates to a telescoping arm gate opening and closing apparatus having a threaded rod actuator that is driven in rotation clockwise and counterclockwise to respectively retract and extend the arm.

2. Background Art

The inconvenience of manually opening and closing a gate has long been recognized. In response, numerous gate openers have been designed that automatically open and close a gate. Examples of prior art gate openers are disclosed in U.S. Pat. Nos. 3,500,585; 4,330,958; 4,403,449; and 4,416,085. None of the prior art devices present a design that is reliable and efficient in operation; inexpensive to manufacture; easy to install; and simple to maintain.

For example, U.S. Pat. No. 3,500,585 discloses a reciprocating ram gate opener having a mechanically complex spring loaded latch mechanism that must be unlatched before the gate can be opened. Thereafter, the entire length of the ram passes through the power unit so that it extends out to the other side of the unit. Since the ram extends from the power unit to the midportion of the gate, the length of the ram is quite long. Passing the long ram through the power unit is inefficient and requires the availability of a commercial source of power to be operated in an economically practical manner. The ram is also cantilever supported from the power unit while the gate is open. This subjects the ram to bending stresses that can eventually cause the ram to bend and the opener to fail in operation.

In the other mentioned U.S. patents, the need for a mechanism to unlatch the gate has been obviated, but the openers include articulated lever actuators that are undesireable. It is inefficient to open a gate by applying a torque to one lever that is pivotally connected to a second lever, which is attached to the gate. This problem is apparent from an analysis of the gate openers disclosed in U.S. Pat. Nos. 4,403,449 and 4,416,085. In each of these patents, a first lever is pivotally mounted at one end for rotation about a vertical axis. In U.S. Pat. No. 4,403,449, a torque is applied to rotate the first lever by a driven gear that is fixed to the lever at the pivot point. This results in an inefficiency created by applying a torque to the lever through a very short moment arm equal to the radius of the driven gear. The latter patent attempts to solve this inefficiency by applying a torque to the pivotally mounted first lever by a reciprocating ram spaced a distance away from the pivot point. This establishes a moment arm of increased length which results in decreasing the work required to rotate the lever, but the mechanical complexity of the opener is increased as a result. Whereas U.S. Pat. No. 4,403,449 requires a motor driven transmission to directly drive a gear driven first lever, the latter patent requires a motor to power a bi-directional gear pump that operates a hydraulically driven ram coupled to the gear pump through hydraulic lines. Therefore, neither of these patents discloses a satisfactorily designed gate opener having a minimum power requirement achieved through a simple and practical mechanical design.

The need exists to provide a gate opening apparatus having a minimum power requirement for operation that does not require a latching mechanism, and that moreover is dependable in operation, inexpensive to manufacture, and simple to install and maintain. Gates are not always located in areas that are accessible to commercially generated power. In these areas gates are provided with battery powered openers. Since all electrically powered openers drain the battery to which they are connected, the battery must be periodically charged. Solar cell panels have been provided to charge the batteries, but the greater the power drain on the battery, the larger the solar cell panel needs to be in order to maintain the battery fully charged. Since solar cell panels are one of the most expensive items in a battery powered gate opener, it is important that the gate opener be designed to use a minimum of power so that the smallest and least expensive solar cell panel can be used to charge the battery. It is also important that the gate opener be constructed from components that are inexpensive and readily manufactured so that it is economically practical to use the gate opener in areas not serviced by commercially generated power.

SUMMARY OF THE INVENTION

It is an object of the invention to provide a reliable and dependable actuating mechanism for a gate opener that holds the gate in the closed or open position thereby obviating the need for a latch. The gate opener of the present invention includes a telescoping arm having a threaded rod that is driven in rotation. This in turn drives a travelling portion of the arm both inwardly and outwardly depending upon the direction of the rod rotation. The travelling portion includes a block having a threaded bore that engages the threads of the rod. By this arrangement, all of the gate opening and closing forces are directed axially and distributed among the threads which are engaged. Therefore, the gate resists being blown open or shut in high wind conditions and is held in the open or closed position without the need for a latch to maintain its position.

It is an object of the invention to provide a gate opener that is efficient in operation by having a low power requirement. This enables the gate opener to be used in remote locations where commercial power is unavailable, since the opener's small power requirements can be met by providing a battery. Preferably, the battery can be continuously charged by a solar cell panel. The low power requirement is achieved by driving the threaded rod in rotation through a pulley and belt transmission. Preferably, the drive pulley is smaller in diameter than the driven pulley so that only a small motor having a low torque output is required. Power losses are further minimized by using solid state circuitry and controls to switch the motor on and off.

It is an object of the invention to provide a gate opening apparatus that is inexpensive in its overall construction and therefore economically practical to use. The belt driven pulley transmission of the invention is readily available and acquired at low cost, as is the small motor which has only a low torque output requirement. Moreover, the low power requirement of the gate opening apparatus of the invention reduces the size and cost of the battery needed to power it in addition to reducing the size and cost of the solar cell panel needed to charge the battery.

It is a further object of the invention to provide a gate opening apparatus that is simple to maintain so that the time saved and convenience afforded by installing an automatic gate opener is not negated by undependable service and time-consuming maintenance procedures. The need for regular maintenance is reduced by the use of a belt driven transmission that requires no regular lubrication, such as would be needed with gear driven or chain driven transmissions. The bearing for the threaded rod can be a sealed bearing that requires no lubrication, or a plain bearing that is lubricated only periodically and which is less expensive to use. Preferably, the block of the travelling portion of the arm is constructed of brass whereas the threaded rod is constructed of hard steel. In combination, these materials work well together without lubrication and without exhibiting excessive wear. In a further preferred construction, the gate opening apparatus is connected to the gate and supported above the ground by a single pivot. Therefore, if the apparatus needs servicing it can be disconnected from the gate and lifted from its pivot support and thereafter transported to a remote location for servicing with the proper tools and equipment.

DESCRIPTION OF THE PREFERRED EMBODIMENT

Figure 1:
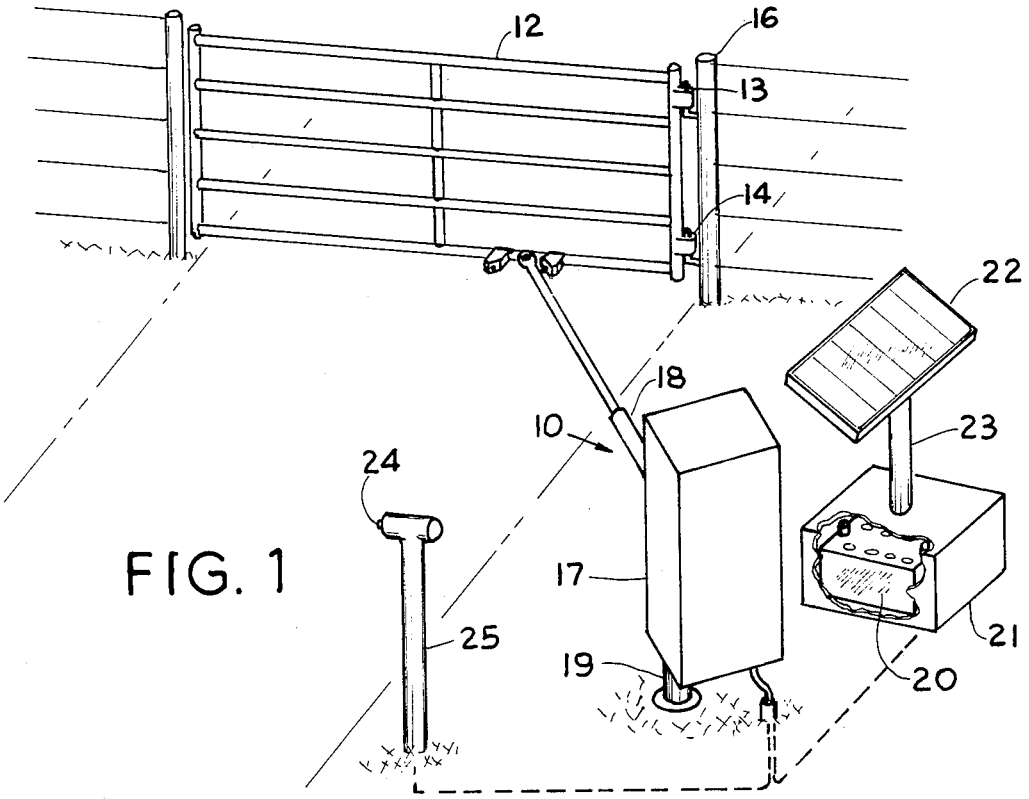
FIG. 1 is a perspective view of the gate opening apparatus along with an exemplary switch for controlling the apparatus and a battery power supply with a solar cell panel battery charger.

The gate opening apparatus is shown in FIG. 1 and indicated generally at 10. It is connected to a gate 12 that is pivotally mounted for swinging between opened and closed positions on hinges 13 and 14, respectively mounted on a post 16 of a fence. As seen in FIG. 1, gate opener 10 includes a housing 17, a telescoping arm 18, and a rotatable shaft support or pivot 19 for supporting the apparatus above the ground.

Preferably, the gate opening apparatus is supplied with power from a battery 20, that can be located within an adjacent housing 21. It is further preferred that a solar cell panel 22 be provided to charge battery 20. Solar cell panel 22 can be mounted in any location that would best receive an adequate amount of sunlight. In FIG. 1, solar cell panel 22 is suitably mounted on housing 21 by support 23.

To operate the gate opening apparatus, a push button switch 24 is mounted on a post 25 to extend above the ground and preferably at a level where the driver of a vehicle can reach it. It is not intended that the gate opening apparatus of the invention be limited in its disclosure to use of a push button switch to control the apparatus. Other commercially available switches can also be used to control the apparatus. For example, sensors can be provided in the roadway on either side of the gate to detect the presence of a vehicle and thereby signal the gate opening apparatus to close or open the gate. Also, a radio transmitting device can be used with the apparatus when the apparatus is provided with a receiver for receiving the radio transmitted signals. However, installing sensors within the roadway requires excavation through the roadway surface, and providing the gate opening apparatus with radio transmitting receiver circuitry adds to the expense of installing the gate opening unit. Therefore, the alternative switches are shown only in block diagram form in FIG. 5.

Figure 2:
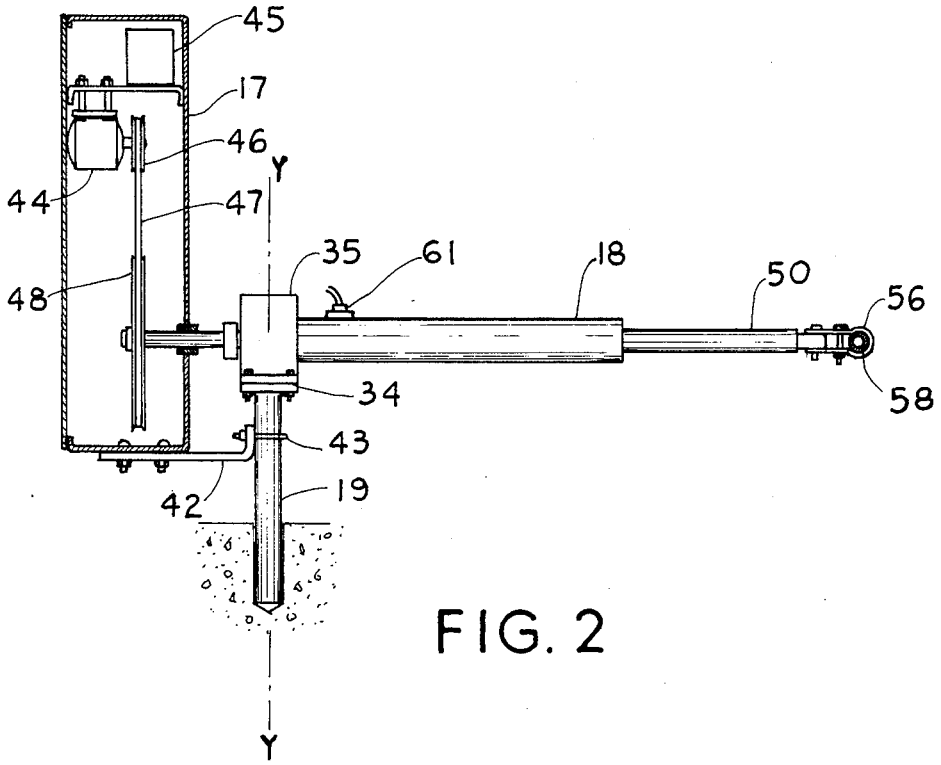
FIG. 2 is a side elevation of the apparatus.
Figure 3:
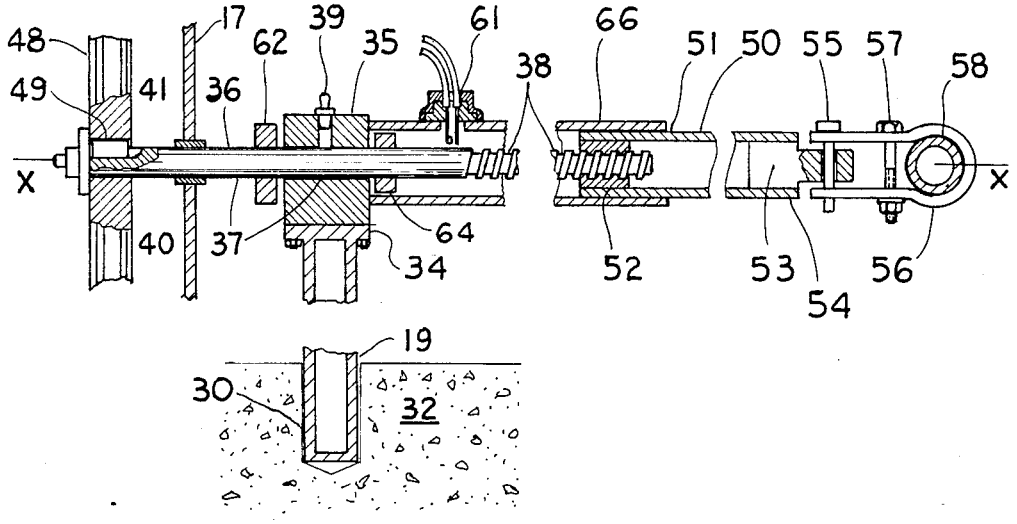
FIG. 3 is a side view of the threaded rod actuator and pivot with details of the actuator and pivot shown in partial section.

FIGS. 2 and 3 show the gate opening apparatus in detail, with FIG. 3 showing details of the threaded rod actuator in partial section. Pivot 19 is supported for rotation about vertical axis Y—Y in bearing 30, which can be provided in a cement foundation 32. Alternatively, a stand could be provided to rotatably receive pivot 19. A suitable construction for bearing 30 would include a slightly V-shaped recess in the bottom portion of a cylindrical bearing in which a ball bearing can be placed for pivot 19 to rotate on.

Pivot 19 supports the apparatus above the ground. At the upper end of pivot 19 is a flange 34. A bearing 35 is mounted to flange 34 and is therefore pivotally supported by pivot 19. Bearing 35 supports a rod 36 in rotation by receiving a journalled portion 37 within the bearing. Preferably, rod 36 is constructed of hard steel and bearing 35 is constructed of bronze or brass, or another suitable bearing material such as Babbitt. Bearing 35 can be self-lubricating or provided with an alemite fitting 39, as shown in FIG. 3, to enable periodic lubrication of the bearing.

As seen in FIGS. 2 and 3, housing 17 is supported by rod 36 and flange 42. One wall of housing 17 includes a through bearing 40 having a bushing 41 that receives an unthreaded portion of rod 36. Much of the weight of housing 17 can be supported on rod 36, but preferably flange 42 is provided at the base of the housing for supporting some of the weight by its connection to pivot 19 through a ring clamp 43. Alternatively, all of the weight of housing 17 could be supported by rod 36 and flange 42 could be connected to pivot 19 by ring clamp 43 so that housing 17 is prevented from rotating about its support on rod 36.

A motor 44 and motor control box 45 are mounted in housing 17 with a pulley transmission having an upper pulley 46, a lower pulley 48, and a belt 47. As seen in FIG. 3, pulley 48 is mounted to rod 36 and fixed for rotation therewith by a key 49. Motor 44 is reversible and drives rod 36 in rotation through the pulley transmission in the clockwise and counter-clockwise directions. Preferably, upper pulley 46 is of a smaller diameter than lower pulley 48. As a result, the speed ratio change between motor 44 and rod 36 provides high speed rotation of rod 36 at a low speed and torque output of motor 44. This allows for the use of a smaller less powerful motor than would be required if the motor were in direct driving engagement with rod 36.

Telescoping arm 18 includes a travelling tubular member 50. A block 52 is located at one end 51 of travelling member 50. Block 52 has a threaded bore for threadedly engaging the threaded portion 38 of rod 36. Preferably, block 52 is constructed of brass, which is a material that works well together with hard steel to provide a long wear life. An extension 53 projects outwardly from end 54 of tubular member 50. Extension 53 can be fixed to tubular member 50 by welding, for example.

Extension 53 provides a point of connection between travelling tubular member 50 and the gate. A clamp 56 encircles one rail 58 of the gate. The clamp can be tightened by a bolt 57 and is provided with upper and lower through holes that can be vertically aligned with a hole provided in extension 53 to allow for the insertion of a pin 55 between clamp 56 and extension 53. This pinned connection allows for pivotal movement between travelling member 50 and rail 58 about an axis parallel with axis Y—Y about which pivot 19 rotates. Also, the pinned connection between travelling member 50 and rail 58 prevents rotation of member 50 about its longitudinal axis. Therefore, it can be seen that as rod 36 rotates, block 52 threadedly engages the threaded portion 38 of rod 36 to cause travelling member 50 to telescopically extend inwardly and outwardly with respect to rod 36.

The rotation of rod 36 causes tubular member 50 to extend inwardly and outwardly thereby transmitting the forces encountered in opening and closing the gate along an axial direction, co-axial with the longitudinal axis X—X of rod 36. To prevent the axially transmitted forces from driving the journalled portion 37 of rod 36 out of bearing 35, collars 62 and 64 are mounted on rod 36 adjacent either side of bearing 35. Preferably, collars 62 and 64 are fixed to shaft 36 by set screws, not shown. Alternatively, the collars could be welded in place or machined as part of the rod. If the collars 62 and 64 are permanently and integrally formed with rod 36, then bearing 35 can be a split bearing to allow for assembly of the apparatus.

As seen in FIG. 3, an outer tubular member 66 is provided that is stationary. Outer member 66 has an inner diameter that is greater than the outer diameter of travelling member 50 so that member 50 is telescopingly received within outer member 66. Outer member 66 protects the threaded portion 38 of rod 36 from contamination with dirt and rain.

A protective limit switch 61 is provided at one end of outer member 66. Limit switch 61 can be of any suitable type, and is generally shown in FIG. 3 as being normally open with two contacts spaced apart. The contacts can be driven together by the end wall of portion 51 of the travelling tubular member to close the switch and signal the motor to stop. Protective switch 61 is provided in addition to limit switches 59 and 60, which operate to signal the motor to stop when the gate is respectively in the open and closed positions as shown in FIG. 4.

The relative positions between the gate opening apparatus and the gate are shown when the gate is in each of the open and closed positions. The gate opening apparatus rotates about pivot 19 as the gate swings between the closed position, shown in dashed lines and the open position, shown in full lines. If limit switch 59 fails to operate, then limit switch 61 is provided to signal motor 44 to shut off. Otherwise, damage could result if tubular member 50 were allowed to retract inwardly past the threaded portion 38. On the other hand, if limit switch 60 fails to operate and motor 44 continues to rotate rod 36 in a counter-clockwise direction, then traveling tubular member 50 would be harmlessly driven off the end of rod 38. Alternatively, an additional protective limit switch could be provided and mounted on outer member 66 that would detect end 51 of member 50 and signal the motor to stop in the event of a failure of switch 60.

Figure 4:
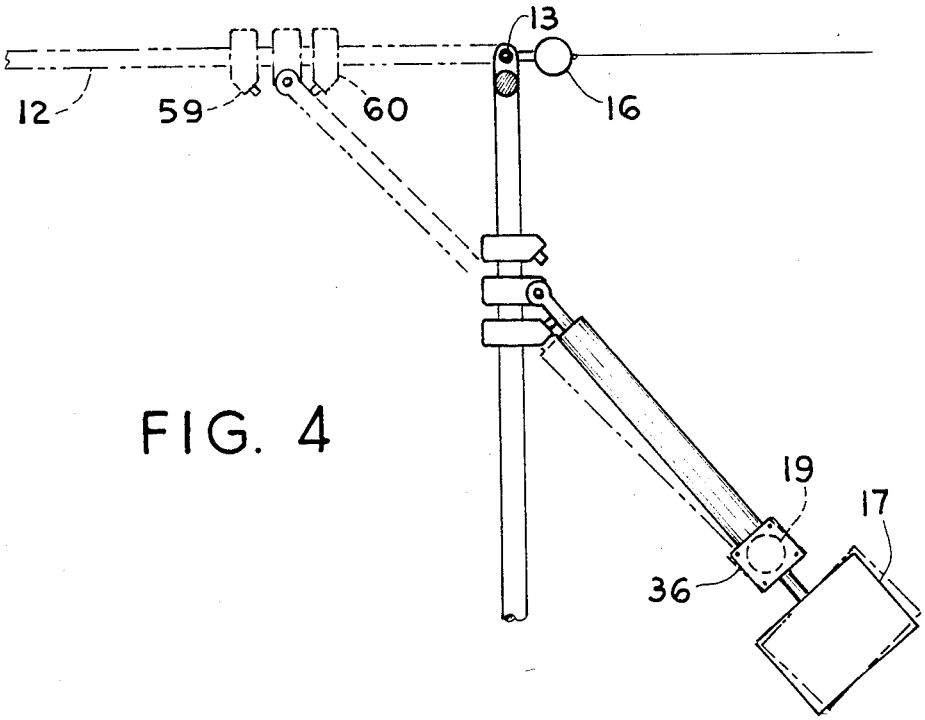
FIG. 4 is a top plan view of the gate opening apparatus connected to a gate showing the relative positions between the gate and the apparatus for the opened and closed positions.

In operation, the gate is closed as shown in full lines in FIG. 4. Motor 44 drives rod 36 in clockwise rotation to retract arm 18 and pull open the gate. As the gate swings open, housing 17 and arm 18 rotate with pivot 19 from the dashed line position shown in FIG. 4 to the position shown in full lines. The gate swings open until limit switch 59 is depressed at which time motor 44 is switched off. From the open position, the direction of rotation of motor 44 is reversed and rod 36 is driven in counter-clockwise rotation to extend arm 18 and swing the gate shut. The gate swings to the closed position and motor 44 is switched off when switch 60 is depressed. As a result of the constant threaded engagement between the stationary rotating rod 36 and traveling member 50, extension and retraction of arm 18 other than that controlled by the rotation of rod 36, is prevented. Therefore, when the gate is in the closed position, no latching mechanism is necessary to retain it in that position, since movement of the gate is dependent on movement of the arm.

Figure 5:
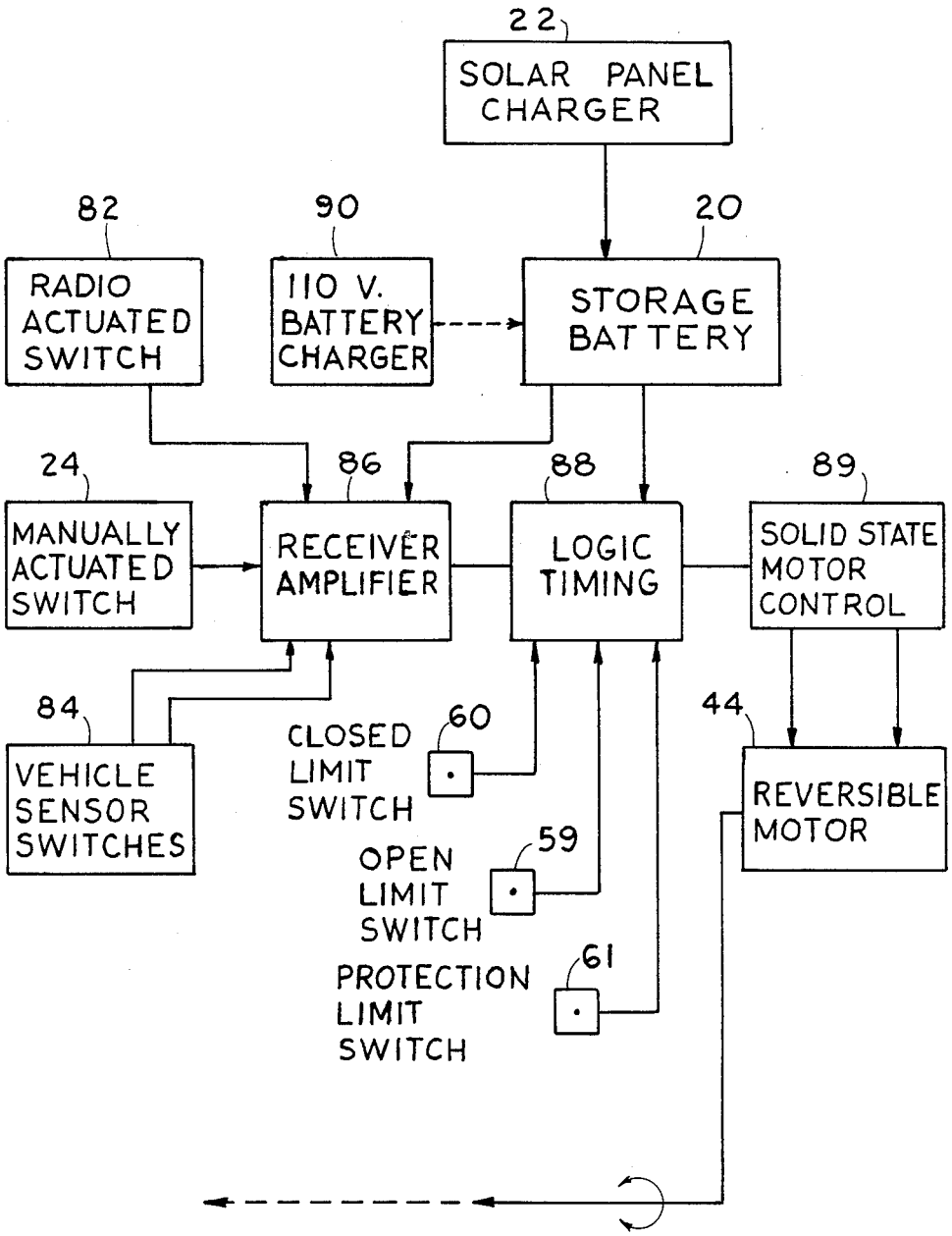
FIG. 5 is a block diagram of the electrical components of the gate opening apparatus.

FIG. 5 shows a block diagram of the electrical components of the invention which are commercially available and function to control the gate opening apparatus by turning the motor on and off and by reversing the direction in which the motor turns. To initiate operation of the apparatus, a switch, such as push button switch 24 shown in FIG. 1, is provided to generate a signal received by a receiver amplifier 86. A radio actuated switch 82 or a vehicle sensor switch 84 can also be used to provide an input to receiver amplifier 86. The output of receiver amplifier 86 is connected to a logic and timing device 88 that additionally has inputs from limit switches 59, 60 and 61.

A signal is received from one of switches 24, 82 and 84 by receiver amplifier 86, which sends a signal to logic and timing device 88. Logic and timing device 88 then sends a signal to the solid state motor control circuit 89 which then drives the reversible motor 44 in either of the forward or reverse directions dependent upon the signal received from logic and timing device 88. If, for example, the open limit switch 59 were the last switch to send a signal to device 88, then device 88 would signal control circuit 89 to drive the motor in the reverse direction, or in a direction that would produce counter-clockwise rotation in rod 36 to thereby drive the gate toward the closed position. Thereafter, when a signal is received from the closed position limit switch 60, device 88 signals the control circuit 89 to turn motor 44 off and change the direction in which motor 44 will rotate next. In this way, the next signal which is received from one of switches 24, 82 and 84 causes motor 44 to be driven in the forward direction, or in a direction that produces clockwise rotation of rod 36 to thereby open the gate. The reversing of motor 44 each time after a signal is received from one of the limit switches can be accomplished by providing a binary flip-flop circuit in the logic and timing device that changes state each time it receives a signal from one of the limit switches. The output of this circuit can then be used to determine in which direction motor 44 should be rotated the next time one of switches 28, 82 and 84 is actuated.

As stated with reference to FIG. 1, it is preferred that storage battery 20 have a solar panel 22 to charge the battery. In FIG. 5, an optionally available 110 V battery charger is shown that could also be used to charge the storage battery in the event that the battery charge gets so low that solar panel 22 does not have the capacity to re-charge it.

It can be seen from the foregoing that the gate opening apparatus of the invention requires only a small power input and is therefore efficient in operation. Also, the apparatus has a practical mechanical design which results in dependable operation. Should servicing be needed, the entire apparatus is mounted on pivot 19 and can be disconnected from the gate, switches and power supply and removed in its entirety for servicing at a remote location. Other routine maintanance can be conducted on site, such as lubricating the bearings. In the event that the gate opening apparatus fails to operate, the gate can be disconnected by removing pin 55. Thereafter the apparatus, including arm 18 can be rotated out of the way about pivot 19 and the gate opened.

Inasmuch as the present invention is subject to many modifications, variations and changes in details, it is intended that all matter contained in the foregoing description or shown on the accompanying drawings, shall be interpreted as illustrative and not in a limiting sense.

I claim:

1. An opening and closing apparatus for a gate hingedly mounted for swinging between open and closed positions, comprising:

pivot means for supporting an arm in rotation about a vertical axis above the ground, said pivot means being spaced apart from the gate and having a vertically extending shaft with upper and lower ends, said shaft being mounted for rotation about a vertical axis and having a flange mounting portion at said upper end;

said arm being extendable along a longitudinal axis, having opposite ends, and including an intermediate bearing mounted on said flange mounting portion for rotation about a vertical axis therewith;

said arm further including a rod having two opposite ends, a threaded portion at one end and being journaled between said ends for rotation in said bearing about said longitudinal axis, a traveling tubular portion having opposite ends and being mounted for movement along said longitudinal axis, and mounted concentrically on said rod, said traveling tubular portion having a block at one of said opposite ends including a threaded bore for engaging the threads of said threaded portion;

a drive mechanism in a housing supported by said vertically extending shaft for driving said threaded potion in rotation about said longitudinal axis and including a reversible, motor, a belt driven pulley system having first and second pulleys and a transmission belt drivingly connecting said pulleys, said housing having frame means for supporting said reversible motor and said first pulley, said first pulley being mounted to said reversible motor, and said second pulley being mounted on second end of said rod for fixed rotation therewith, said reversible motor being drivingly connected with said threaded rod through said belt driven pulley system to drive said threaded rod in clockwise and counter-clockwise rotation; and means for connecting the second of said opposite ends of said traveling tubular portion to the gate to prevent rotational movement of said traveling member about said longitudinal axis while permitting pivotal movement between said traveling member and the gate when said threaded portion is rotated to drive said block and said traveling tubular portion along said threaded portion to extend or retract said traveling tubular portion along said longitudinal axis such that the gate is driven toward the open or closed positions.

2. The opening and closing apparatus as claimed in claim 1 further comprising solar cell panel means for generating electricity and battery storage means for storing the electricity generated by said solar panel means, the electricity being used for powering said reversible motor such that said gate opening and closing apparatus is functional in remote locations where commercially generated power is unavailable.

3. The opening and closing apparatus as claimed in claim 2, further comprising:

a second housing having a through bearing for receiving said threaded rod, said threaded rod supporting said second housing, and a flange having a circular clamp for receiving said shaft of said pivot means for preventing said second housing from rotation about said rod.

4. An opening and closing apparatus as claimed in claim 3, further comprising:

first and second stop collars fixed to said rod and positioned one on each side of said bearing for preventing said threaded rod from moving longitudinally with respect to said bearing; and an outer protective tubular member extending between said bearing and said one of said ends of said threaded portion, said outer tubular member being fixedly connected to said bearing and concentrically mounted with respect to said rod and having an inner dimension greater than the outer dimension of said traveling portion.

* * * * *